United States Patent [19]

Le Roy

[11] 3,939,848

[45] Feb. 24, 1976

[54] SMOKING ARTICLE

[76] Inventor: George Le Roy, 9649 LeClaire Ave., Skokie, Ill. 60076

[22] Filed: Jan. 16, 1975

[21] Appl. No.: 541,637

[52] U.S. Cl. ..... 131/10 R; 131/10.3; 131/10.5; 131/10.9; 131/11; 131/264

[51] Int. Cl.[2] A24B 15/027; A24D 1/04; A24F 1/02

[58] Field of Search ..... 131/9 R, 10 R, 10.1, 10.3, 131/10.5, 264

[56] References Cited

UNITED STATES PATENTS

| | | | |
|---|---|---|---|
| 2,794,480 | 6/1957 | Crawford et al. | 131/10 R X |
| 2,830,593 | 4/1958 | Campbell | 131/9 X |
| 3,164,157 | 1/1965 | Lebert | 131/10.3 X |
| 3,334,636 | 8/1967 | Zuber | 131/10.1 |
| 3,461,880 | 8/1969 | Stubblefield | 131/9 |

FOREIGN PATENTS OR APPLICATIONS

| | | | |
|---|---|---|---|
| 1,249,139 | 8/1967 | Germany | 131/10.3 |
| 436,019 | 10/1935 | United Kingdom | 131/10 R |

*Primary Examiner*—Robert W. Michell
*Assistant Examiner*—V. Millin
*Attorney, Agent, or Firm*—Molinare, Allegretti, Newitt & Witcoff

[57] ABSTRACT

The smoking article disclosed includes a novel filter for removing a substantial portion of the potentially harmful tars, resins, nicotine, etc. from the tobacco smoke from the smoking article. The novel filter comprises an assemblage of crimped, cellulose acetate fibers and includes first and second zones having elongated, elliptical traverse crosssections and a transition zone therebetween. A portion of the fibers in the first zone and a portion of the fibers in the transition zone are orientated transversely to the longitudinal axis of the filter.

4 Claims, 7 Drawing Figures

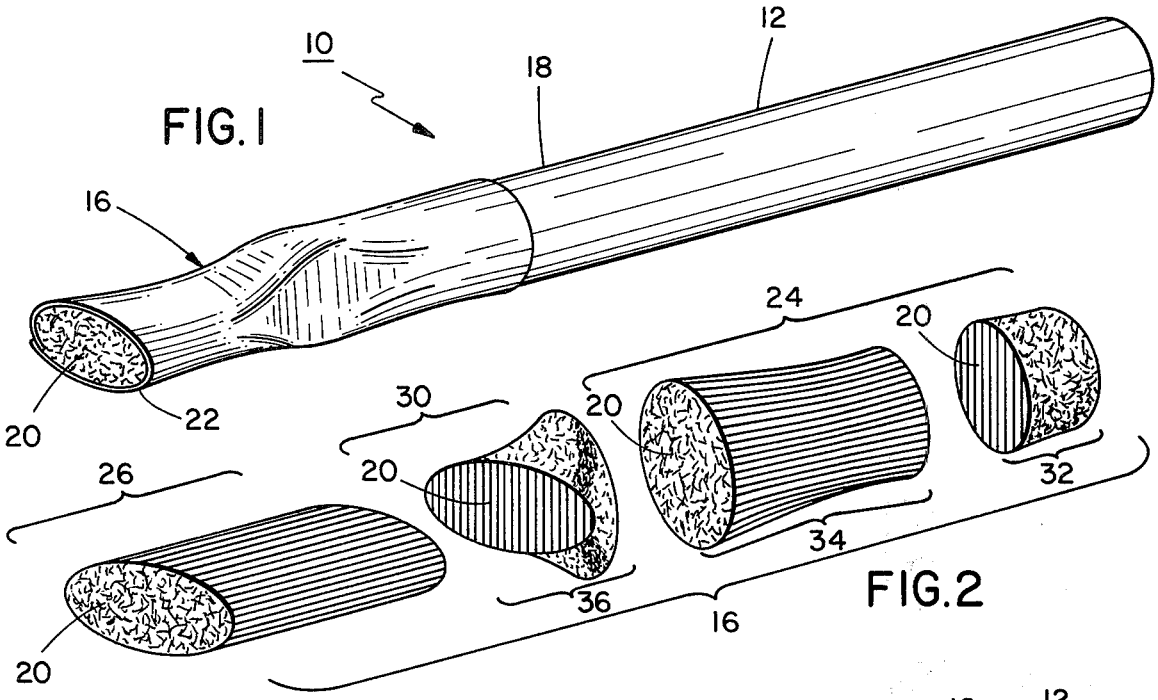
FIG. 1
FIG. 2
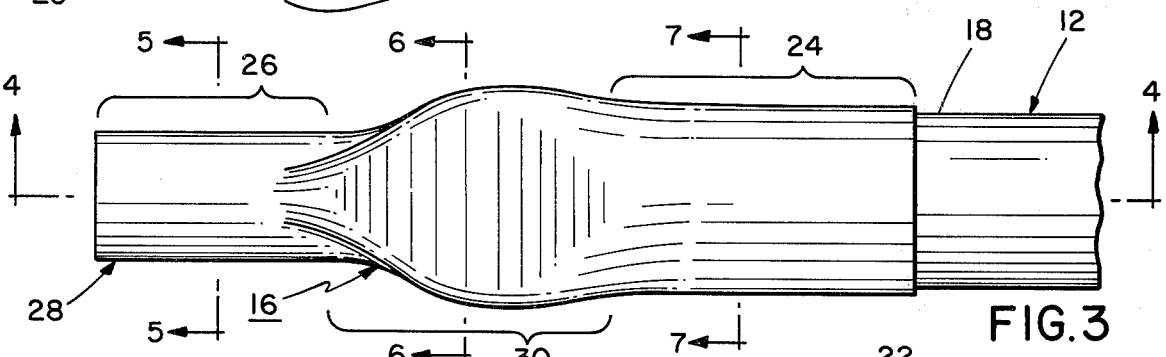
FIG. 3
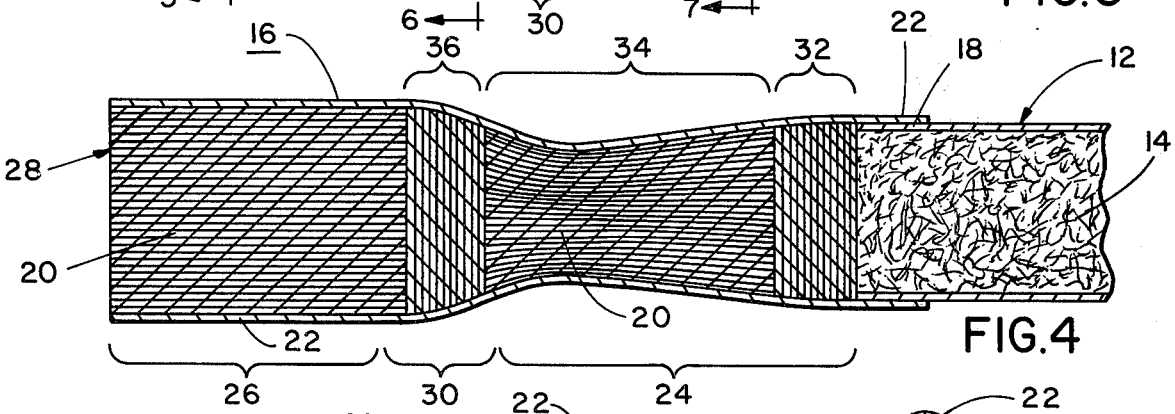
FIG. 4
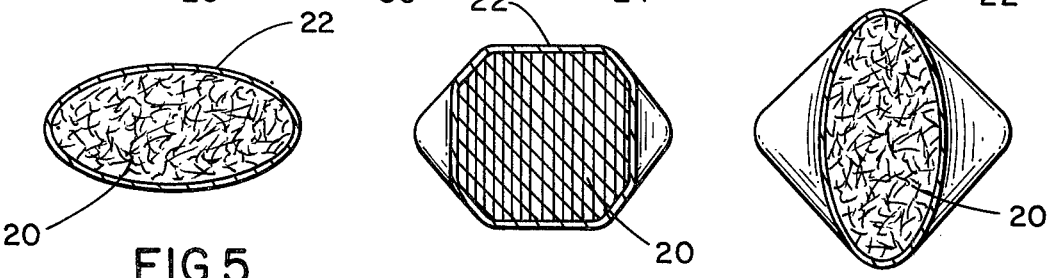
FIG. 5
FIG. 6
FIG. 7

SMOKING ARTICLE

BACKGROUND AND SUMMARY OF THE INVENTION

The present invention relates to smoking articles, and more particularly, to an improved smoking article, such as a cigarette or the like, having a novel filter for removing the potentially harmful tars, resins, nicotine, etc. from the tobacco smoke.

For a number of years, it has been recognized that the inhalation of tobacco smoke may be injurious to the smoker's health. In fact, a report by the Surgeon General of the United States indicates that excessive inhalation of tobacco smoke may cause lung cancer and that there may be a direct relationship between the number of cigarettes smoked and incidents of circulatory diseases.

Consequently, a significant percentage of the cigarettes manufactured and sold in the United States today include filters, with these filters being designed and intended to remove, to the extent possible, the injurious tars, resins, nicotine, etc. from the tobacco smoke. A variety of different filters and filtering devices have been proposed over the years for use with cigarettes and other smoking articles. Examples of such filters and filtering devices are disclosed in U.S. Pat. Nos. 2,954,778, issued in the name of H. A. Lebert; 3,010,458, issued in the name of H. A. Lebert; 3,062,218 issued in the name of C. E. Temkovits; 3,079,926 issued in the name of H. R. Litchfield et al; 3,334,636 issued in the name of A. A. Zuber; 3,504,678 issued in the name of R. E. Pitt; 3,515,146, issued in the name of R. N. Nealis; 3,690,326, issued in the name of F. R. Davenport; and 3,738,375, issued in the name of G. C. Doumas.

While the filters and filter devices disclosed in the aforementioned patents are said to remove the potentially harmful tars, resins, nicotine, etc. found in tobacco smoke, none has apparently enjoyed commercial success and acceptance. The most common type of cigarette filter utilized commercially today is a cylindrical rod comprising an assemblage of fibers or filaments made of a cellulose or similar material wherein the fibers or filaments are oriented in direction parallel to the longitudinal axis of the cigarette filter.

It is a primary object of the present invention to provide an approved smoking article, such as a cigarette, which includes a novel filter that is capable to removing a substantial portion of the potentially harmful tars, resins, nicotine, etc. from the tobacco smoke. More specifically, the novel filter of my invention includes an assemblage of crimped, cellulose acetate fibers which are disposed within an outer wrapper and attached to one end of a cigarette in a conventional manner. My filter includes: a first zone which is adjacent to the rear end of the cigarette and which has an elongated, elliptical cross-section in a plane transverse to the longitudinal axis of the filter; a second zone which is adjacent to the end of the filter adapted to be placed in the mouth of a smoker and which has an elongated, elliptical cross-section in a plane transverse to the longitudinal axis of the filter, with the major axis of the elliptical cross-section of the second zone being substantially perpendicular to the major axis of the elliptical cross-section of the first zone; and a transition zone which is disposed between the first and second zone and which has a varying, non-circular cross-section that provides a smooth transition between the first and second zones. A portion of the fibers in the first zone are oriented in a direction transverse to the longitudinal axis of the filter and is disposed adjacent to the rear end of the cigarette. A portion of the fibers in the transition zone are likewise oriented in a direction substantially transverse to the longitudinal axis of the filter, with the orientation of the fibers in these two portions being parallel. The remaining fibers in the cigarette filter are oriented in a direction substantially parallel to the longitudinal axis of the filter. Thus, the smoke must travel through multiple zones or filter portions before inhalation by the smoker.

Aside from the improved filtering characteristics of my improved filter, one of the principal advantages of the novel filter of my invention is that it can be manufactured relatively inexpensively, as compared to the filters and filter devices shown in the aforementioned patents. Moreover, my novel filter can be made from materials that are already being used to manufacture cigarettes marketed today. This should facilitate the commercial acceptance of the smoking articles utilizing my novel filter.

These and other objects and advantages of the present invention will become apparent from the following description of the preferred embodiment of my present invention described in connection with the accompanying drawings:

BRIEF DESCRIPTION OF THE DRAWINGS

FIG. 1 is a perspective view of an improved smoking article of the present invention.

FIG. 2 is an exploded, perspective view illustrating the various zones included in the novel filter utilized with the improved smoking article.

FIG. 3 is a side plan view of the rear end of the improved smoking article shown in FIG. 1.

FIG. 4 is a longitudinal, cross-sectional view taken along the line 4—4 in FIG. 3.

FIG. 5 is a transverse, cross-sectional view taken along the line 5—5 in FIG. 3.

FIG. 6 is a transverse, cross-sectional view taken along the line 6—6 in FIG. 3.

FIG. 7 is a transverse, cross-sectional view taken along the line 7—7 in FIG. 3.

DESCRIPTION OF THE PREFERRED EMBODIMENT

Referring now to the drawings, a smoking article, or more specifically a cigarette, embodying the principals of my present invention is shown generally at 10. The cigarette 10 includes a generally cylindrical or tubular outer wrapper 12 which is made from conventional cigarette paper and which is quite thin and readily combustible. A rod or elongated tubular amount of relatively tightly packed tobacco 14 is disposed within the outer wrapper 12. The tobacco 14 is a type commonly utilized in commercially available cigarettes and may be prepared by chopping or shredding tobacco leaves. When the cigarette 10 is smoked, the outer wrapper 12 and the tobacco are burned and their products of combustion are drawn rearwardly through the cigarette 10 and into the respiratory system of the user or smoker if he inhales. These products of combustion entrained in the smoke include certain potentially harmful tars, resins, nicotine and the like which are said to be detrimental to the health of the smoker if they are inhaled.

A novel filter 16 is connected to the rear end 18 of the cigarette for the purpose of removing all or substantially all of the tars, resins, nicotine, etc. from the smoke. The filter 16 includes an assemblage of several thousand crimped, cellulose acetate fibers which are arranged together in a generally unitary rod. The fibers 20 may be made of commercially available materials through the use of conventional processes. The fibers 20 are disposed in and are surrounded by a commercially available outer wrapper 22 which provides the filter 16 with a smooth outer appearance.

In order to obtain the improved filtering results, the filter 16 is divided into a plurality of zones. A first zone 24 is disposed adjacent to the rear 18 of the cigarette 12. The first zone 24 has a generally elongated, elliptical cross-section, in a plane transverse to the longitudinal axis of the filter 16.

A second zone 26 is formed adjacent to the rear end 28 of the filter 16; the rear end 26 being the end of the filter which is adapted to be placed in the smoker's mouth. This second zone has a generally elongated, elliptical cross-section, in a plane transverse to the longitudinal axis of the filter 16. The major axis of the elliptical cross-section of the first zone 26 is disposed at an angle substantially equal to ninety degrees with respect to the major axis of the elliptical cross-section configuration of the first zone 24.

A third zone 30 is disposed between the first and second zones 24 and 26 and provides a smooth transition from the first and second zones 24 and 26. The third zone 30 has a varying, non-circular cross-section in a plane transverse to the longitudinal axis of the filter 16.

The first zone 24 is divided into two sub-zones 34 and 36. The sub-zone 34 is disposed adjacent to the rear end of the cigarette 10 while the sub-zone 36 is disposed between the third or transition zone 30 and the sub-zone 34. The fibers 20 in the sub-zone 32 are orientated transversely to the longitudinal axis of the filter while the fibers 20 in the sub-zone 34 are orientated so that they are generally disposed in a direction substantially parallel to the longitudinal axis of the filter 16.

A portion 36 of the fibers 20 in the third zone are likewise orientated transversely to the longitudinal axis of the filter and are aligned in a direction generally parallel to the fibers in the portion 32 of the first zone 24. The remaining fibers 20 in the third zone 30 and the fibers in the second zone 26 are disposed generally parallel to the longitudinal axis of the filter 16.

Thus as a result of construction of the filter 16, smoke from the cigarrette 12 must pass through four different and distinct zones, i.e., zones 26 and 30 and the sub-zones 32 and 34 of the zone 24. This passage affords a significant filtering action and smoke emitted from the rear end 28 of the filter 16 is relatively free of potentially harmful tars, resins, nicotine, etc.

Although the particular shape or configuration of the novel filter 16 can be achieved through the use of automatic machinery, the same shape or configuration may also be obtained through manual manipulation as follows: starting with a cylindrically or tubularly shaped filter, the portion of the filter 16 adjacent to the rear end 28 of the filter is "pinched" between the thumb and forefinger of one hand. The filter 16 is then rotated through an arc of 90 degrees and the portion of the filter 16 adjacent to the rear end 18 of the cigarette 10 is likewise "pinched" between the thumb and forefinger of the person's other hand. This double "pinching" effect causes the first and second zones 24 and 26 of the filter 16 to assume an elongated, elliptical shape or configuration. As noted above, the third zone 30 provides a smooth transition between the first and second zones 24 and 26.

In view of the foregoing it should be apparent to those having skill in this art that the improved cigarette of my present invention provides a novel means for filtering the products of combustion from the cigarette smoke. My novel filter is relatively simple in design and construction, and therefore may be manufactured relatively inexpensively. This, of course, is a significant advantage from the standpoint of commercializing the improved smoking article of the present invention.

Since the invenion disclosed herein may be embodied in other specific forms without the parting from spirit or central characteristics thereof, the preferred embodiment described hereinabove is therefore to be considered in all respects as illustrative and not restrictive, the scope of the invention being indicated by the appended claims, rather than by the foregoing description, and all changes which come within the meaning and range of equivalency of the claims are therefore intended to be embraced therein.

I claim:

1. An improved smoking article comprising:

a generally cylindrical, combustible first outer wrapper having first and second ends;

an amount of tobacco disposed in and filling the first outer wrapper between its ends and adapted, with the first outer wrapper, to be burned; and filter means for filtering products of combustion which pass there through in a direction parallel to the longiudinal axis of the filter means and which result from the burning of the tobacco, the filter means comprising:

one end that is connected with a first end of the first outer wrapper;

another end that is adapted to be placed in the mouth of the smoker;

a second outer wrapper; and an assembly of crimped, cellulose acetate fibers disposed in and filling the second outer wrapper; the filter means comprising:

a first zone adjacent to the one end of the filter means and having an elongated, elliptical cross-section in a plane transverse to the longitudinal axis of the filter means;

a second zone adjacent to the other end of the filter means and having an elongated, elliptical cross-section in a plane transverse to the longiudinal axis of the filter means, with the major axis of the transverse cross-section of the second zone being disposed at an angle of substantially ninety degrees to the major axis of the transverse cross-section of the first zone; and a third zone disposed between the first and second zones and having a varying, non-circular cross-section containing fibers transverse to the central longitudinal axis wherein said third zone provides a smooth transition between the first and second zones.

2. The improved smoking article described in claim 1 wherein the first filter zone comprise a plurality of sub-zones and the fibers in one said sub-zone are orientated transversely to the longitudinal axis of the filter means.

3. The improved smoking article described in claim 2 wherein said sub-zone is disposed adjacent to the first end of the first outer wrapper.

4. The improved smoking article described in claim 2 wherein the remaining fibers in the first and second filter zones are orientated generally parallel with respect to the longitudinal axis of the filter means; and wherein the fibers in said sub-zone in the first zone and in said portion of the third zone are orientated parallel to each other.

* * * * *